US006945244B2

(12) United States Patent
Yamada

(10) Patent No.: US 6,945,244 B2
(45) Date of Patent: Sep. 20, 2005

(54) RANGE HOOD

(75) Inventor: Yoshihiro Yamada, Gifu (JP)

(73) Assignee: Yamazen Co., Ltd., Gifu (JP)

( * ) Notice: Subject to any disclaimer, the term of this patent is extended or adjusted under 35 U.S.C. 154(b) by 0 days.

(21) Appl. No.: 10/934,211

(22) Filed: Sep. 3, 2004

(65) Prior Publication Data

US 2005/0051159 A1 Mar. 10, 2005

Related U.S. Application Data

(63) Continuation of application No. PCT/JP03/00697, filed on Jan. 24, 2003.

(30) Foreign Application Priority Data

Jul. 26, 2002 (JP) ..... 2002-218505

(51) Int. Cl.[7] ..... F23J 11/00

(52) U.S. Cl. ..... 126/299 D; 126/299 R; 126/299 F; 454/67

(58) Field of Search ..... 126/299 D, 299 R, 126/299 E, 299 F; 454/49, 67

(56) References Cited

U.S. PATENT DOCUMENTS

| | | | | | |
|---|---|---|---|---|---|
| 3,800,689 | A | * | 4/1974 | Brown | 126/299 D |
| 4,050,367 | A | * | 9/1977 | Eakes | 454/56 |
| 4,108,051 | A | * | 8/1978 | Eakes | 454/56 |
| 4,125,062 | A | * | 11/1978 | Eakes | 454/56 |
| 4,127,106 | A | * | 11/1978 | Jensen | 126/299 D |
| 2004/0149278 | A1 | * | 8/2004 | Lin | 126/299 R |

FOREIGN PATENT DOCUMENTS

| | | |
|---|---|---|
| JP | 01-306753 | 12/1989 |
| JP | 09-280621 | 10/1997 |

* cited by examiner

*Primary Examiner*—Alfred Basichas
(74) *Attorney, Agent, or Firm*—Peacock Myers, P.C.; Jeffrey D. Myers; Janeen Vilven

(57) ABSTRACT

The present invention relates to a range hood for evacuating air or emitted gas, which contains oily smoke and the like generated by cooking on a range, to the outside of a house.

3 Claims, 5 Drawing Sheets

RANGE HOOD

TECHNICAL FIELD

The present invention relates to a range hood for evacuating air or emitted gas, which contains oily smoke and the like generated by cooking on a range, to the outside of a house.

As for ranges used in a kitchen, the following two types are available; i.e., one that burns fuel gas such as city gas to obtain source of heat, and emits carbon dioxide gas; and one that uses electric power in place of fuel gas, such as electromagnetic cooking appliances. In the latter case, carbon dioxide gas is not generated. However, due to the cooking on the range, vapor containing oily smoke, smell and the like is emitted. Therefore, hereinafter, in the case of cooking appliances that burn fuel gas, the wording "emitted gas containing oily smoke and the like" is used. In the case of cooking appliances that use electricity, like electromagnetic cooking appliances, the wording "air containing oily smoke and the like" is used.

BACKGROUND ART

Various types of range hoods have been proposed. The basic constitution in the range hoods is as described below. That is, an evacuating fan, which is incorporated in a hood main body, draws air or emitted gas, which contains oily smoke or vapor generated by cooking, and the air or emitted gas is evacuated to the outside of a house through an evacuating duct. Here, it is arranged so that the hood, which is largely opened downward over the kitchen range, traps the emitted gas.

In these days, so to speak "electromagnetic cooking appliances", which employ the electricity, have been evolved and are as widely used as kitchen ranges that burn a gas to obtain source of heat necessary for cooking. In these electromagnetic cooking appliances, emitted gas, which contains carbon dioxide gas, is not generated. However, cooking generates vapor, which contains oily smoke and smell. It is needless to say that such oily smoke and the like has to be evacuated to the outside of a house.

Also, such electromagnetic cooking appliances as described above do not burn a gas. Therefore, the combustion air the gas is not required. However, satisfactory ascending air current like emitted gas, which is generated by burnt gas, cannot be formed. That is, when an electromagnetic cooking appliance is used, all of the oily smoke and vapor, which are generated by cooking, do not reach to the range hood, and in many cases, some part of them spreads in a kitchen. Particularly, for the range hood, it is preferred to provide a height of 80 cm or more from a pan or frying pan to the range hood. Accordingly, the spreading of the air containing such oily smoke and the like outside the range hood; i.e., the spreading in the kitchen is unavoidable.

Needless to say, in a range hood, which has the basic constitution as described above, the structure of the evacuating fan is important. That is, a silent evacuating fan having a strong evacuating power is required. The applicant of the present invention has proposed a technique concerning an evacuating fan, which is suitable to apply to such range hood, in Japanese Patent No. 260928 and the like. Also, the applicant has disclosed various techniques concerning the relevant hoods in the Japanese Patent No. 2920494, No. 2920494 and No. 3277250.

Owing to these techniques of the applicant, in range hood as described above, emitted gas and air, which contains oily smoke and the like, can be reliably drawn to a certain extent. However, in addition to the above-mentioned problems that, in the case of electromagnetic cooking appliances, insufficient ascending air current in kitchens must be solved, there still reside many other problems to be solved. For example, there reside such problems as "cleaning" as well as "air supply" in recent housings with a high airtightness.

First, in view of "cleaning", as described above, emitted gas, which is generated in a kitchen, contains "oily smoke". The oily smoke is generated while cooking flies and stir-fry using oil. The oily smoke accumulates into liquid on walls of the kitchen and the hood resulting in a residue. Particularly, being located close to the frying pan and the like, interior wall 30 at the rear side of a kitchen range as shown in FIG. 1 is an area where "oily residue" readily accumulates. Since the "oily residue" is extremely difficult to remove, every family suffers hard work to remove it.

On the other hand, in view of "air supply", in a room (kitchen) having a high airtightness, unless special equipment is provided, it is impossible to introduce fresh air used for combustion. When cooking is carried out in a kitchen with a high airtightness, even when a strong range hood is available, fresh combustion air has to be supplied from the inside of the kitchen. Accordingly, emitted gas generated on the kitchen range is spread in the kitchen.

Particularly, in a kitchen with an extremely high airtightness like recent collective housings, due to its high airtightness, it is extremely difficult to supply and evacuate the air by means of air supply fan or natural convection only.

The inventor of the present invention has extensively examined how such range hood can be achieved. That is, in the case where an electromagnetic cooking appliance is used, not only can unsatisfactory ascending air flow be supplemented, but also accumulation of oily residue is on the interior wall is minimized, and still more, even when no special equipment is provided, the air for cooking can be supplied. As a result, the inventor found the fact that, in the emitted gas evacuated from the evacuating duct, not only carbon dioxide gas and vapor but also a part of the air in the room is included, and achieved the present invention.

The present invention has been achieved in view of the above-described problems in the range hoods. Accordingly, an object of the present invention is to provide a range hood that is capable of not only reliably evacuating the air or emitted gas, which contains vapor or the like, to the outside of the house, but also supplementing insufficient ascending air current with air sufficiently to guide the same to the inside of the hood, and preventing oily residue from accumulating on the surface of the interior wall, and further, even in a kitchen with a high airtightness, supplying the air satisfactorily.

DISCLOSURE OF THE INVENTION

In order to solve the above-described problems, the present invention employs the following means as described below being attached with reference numerals, which are used in the description of best mode for carrying out the invention described later; that is, "a range hood 10 comprising a hood main body 11, which is attached to an interior wall 30, for evacuating air or emitted gas containing oily smoke, vapor and the like generated by cooking on a kitchen range 40, a hood 12, which is opened at the lower end of the hood main body 11, for taking ascending emitted gas therein, an evacuating fan 13, which is incorporated in the hood main body 11, with a suction port thereof located in the hood main body 11, and an evacuating port 13*b*, which is formed in the upper portion of the evacuating fan 13 so as to be connected with an evacuating duct 20, characterized in that in the hood main body 11 and at the backside of the evacuating fan 13, a bypass 14 for said air or emitted gas containing oily smoke is formed, one end of the bypass 14 is communicated with the evacuating port 13*b* of the evacuating fan 13, and the other end of the bypass 14 is opened at the lower end of the hood main body 11 located at the wall 30 side of the hood adjacent to the wall (or surface) and below the evacuating fan 13, and in the bypass 14, an electric fan 18 is provided."

That is, in the range hood 10, as shown in FIG. 1, the bypass 14 is formed in the hood main body 11. One end of the bypass 14 is connected to the evacuating port 13*b* of the evacuating fan 13; and the other end is, as shown in FIG. 3, opened with the blowing ports 14*a*. And in the other end of the bypass 14, as shown in FIG. 1–FIG. 5, the electric fan 18 is provided. In other words, the range hood 10 is equipped with a hood main body 11, which is attached to an interior wall 30, for evacuating air or emitted gas containing oily smoke, vapor and the like generated by cooking on a kitchen range 40, a hood 12, which is opened at the lower end of the hood main body 11, for drawing ascending emitted gas therein, an evacuating fan 13, which is incorporated in the hood main body 11, with a suction port thereof located in the hood main body 11, and an evacuating port 13*b*, which is formed in the upper portion of the evacuating fan 13 so as to be connected with an evacuating duct 20, wherein, in the hood main body 11 and at the backside of the evacuating fan 13, the bypass 14 for said air or emitted gas containing oily smoke is formed, one end of the bypass 14 is communicated with the evacuating port 13*b* of the evacuating fan 13, and the other end of the bypass 14 is opened at the lower end of the hood main body 11 located at a wall 30 side of the hood and below the evacuating fan 13.

Owing to this, the basic operation of the range hood 10 is as described below. That is, when the range hood 10 is activated, the evacuating fan 13 draws the air in an area above the kitchen range 40. Accordingly, the air containing oily smoke, smell or vapor, which are generated by cooking on the kitchen range 40, or in the case of the type that burns a fuel (gas), the emitted gas containing carbon dioxide gas, is trapped by the hood 12, which opens downward. And the air is drawn into the hood main body 11, and finally evacuated to the outside through the evacuating duct 20, which is opened to the outside of the house by means of evacuating force of the evacuating fan 13.

Needless to say, same as ordinary range hood, in the range hood 10, a filter 15 for trapping oily smoke is provided in the hood main body 11. By the filter 15 also, a large part of the oily smoke is removed from the air or emitted gas ascending from the kitchen range 40, which contains the oily smoke.

In the range hood 10 in accordance with the present invention, the bypass 14 of which one end is communicated with the evacuating port 13*b* at the upper side of the evacuating fan 13 and the other end thereof is opened as the blowing ports 14*a* in an area at the wall 30 side of the hood. Accordingly, in the flow of the emitted gas as described above, a part of the air or emitted gas, which contains the oily smoke drawn by the evacuating fan 13, flows into the bypass 14, and is supplied to the area above the kitchen range 40 from each of the blowing ports 14*a*, which are opened above the range 40.

Here, in the bypass 14 inside each of the blowing ports 14*a*, as shown in FIG. 1 and so on, the electric fan 18 is provided. The electric fan 18 operates in the bypass 14 to feed a part of the air or emitted gas, which contains the oily smoke drawn by the evacuating fan 13, toward the blowing ports 14*a*.

Further, as shown in FIG. 3, the blowing ports 14*a* are opened in front of the surface of the interior wall 30 (side wall of the room). Accordingly, as indicated with the dotted arrowheads at the right-hand in FIG. 1 and FIG. 4, the air is supplied from each of the blowing ports 14*a* toward the kitchen range 40. The air supply is, in addition to the operation of the evacuating fan 13, accelerated by the operation of the above-mentioned electric fan 18. Accordingly, the airflow indicated by dotted arrowheads at the right-hand is hardly disturbed by, for example, a cross wind in the room, and reliably flows toward the kitchen range 40.

The air or emitted gas, which is supplied toward the kitchen range 40 from each of the blowing ports 14*a*, is in a state that the latent heat still remains therein. Accordingly, as indicated with black solid arrowheads in FIG. 1 and FIG. 4, a kind of ascending air current is formed. Therefore, even when the kitchen range 40 is an electromagnetic cooking appliance, which does not generate ascending air current with a satisfactory strength due to the emitted gas, the air or emitted gas supplied from each of the blowing ports 14*a* is completely guided to the inside of the hood 12.

Also, the air or emitted gas, which is supplied toward the kitchen range 40 from each of the blowing ports 14*a*, descends while forming a kind of air curtain in front of the surface of the interior wall 30. As a result, the oily smoke, which is generated from a frying pan or the like on the kitchen range 40, is blocked by the air curtain and does not come into contact with the surface of the interior wall 30. Thus, the oily smoke is prevented from accumulating on the surface of the interior wall 30. Accordingly, by using the range hood 10, at least it is possible to prevent the oily residue from accumulating on the surface of the interior wall 30, thus the cleaning of the interior wall 30 can be reduced to a certain extent.

The above-described matter is extremely important in the case where an "electromagnetic cooking appliance", which has been increasing recently, is employed as the kitchen range 40. In electromagnetic cooking appliances, the combustion air is not required. However, it is needless to say that the electromagnetic cooking generates the oily smoke. The fact that the oily smoke is prevented from coming into direct contact with the interior wall 30 is an important working of the range hood 10 because the kitchen can be kept clean and the cleaning can be reduced.

Further, from each of the blowing ports 14*a*, a part of the emitted gas, which contains the air, is supplied toward the kitchen range 40. Accordingly, in such type that the kitchen range 40 burns a fuel gas, apart of the oxygen necessary for the kitchen range 40 is supplied. In other words, even when a special air intake or device is not provided in the kitchen, which is equipped with the range hood 10, the combustion air, which is necessary for the kitchen range 40, is satisfactorily supplied while ensuring the air tightness of the kitchen.

Accordingly, the range hood 10 in accordance with the present invention is capable of, needless to say that the emitted gas containing oily smoke and the like can be evacuated to the outside of the house, preventing the oily residue from accumulating on the surface of the interior wall 30, and further, supplying sufficient air even in a kitchen with a high air tightness.

In the range hood 10, within the evacuating port 13*b* of the evacuating fan 14, a shutter 16, which controls the feeding of the air or emitted gas to the bypass 14, is also provided.

That is, in the range hood 10 provided with the shutter 16, it is arranged so that the shutter 16 controls the amount of the air or emitted gas, which is fed to the bypass 14. The opening of the shutter 16 (the level of the air or emitted gas, which is guided to the evacuating duct 20) can be controlled by, for example, a control dial provided in a lower portion of the front face or in the bottom face of the hood main body 11. Needless to say that it is the simplest way to provide the shutter 16 within the evacuating port 13*b* of the evacuating fan 14. Also, since the range hood 10 can be packaged into a unit as a finished article of commerce, this manner is convenient.

When the shutter 16 as described above is provided, by controlling the opening thereof in accordance with the air tightness of the kitchen, it is possible to supply the air satisfactorily for forming the flow, which contains the oily smoke or the combustion air necessary for the kitchen range 40. For example, in the winter, to minimize the introduction of cold air from the outside, the opening of the shutter 16 can be set to the maximum; and during a strong wind such as typhoon or the like, the opening of the shutter 16 can be set to the minimum; in a situation other than the above, the opening of the shutter 16 may be controlled appropriately.

Accordingly, the range hood 10, which is provided with the shutter 16, is capable of controlling the feeding of the air or emitted gas, which contains the oily smoke, to the bypass 14 by the shutter 16.

Further, in the range hood 10, within the bypass 14 thereof, a bypass filter 17 for absorbing smell or carbon dioxide gas from the air or emitted gas is provided.

That is, in the range hood 10 provided with the bypass filter 17, it is arranged so that the smell and carbon dioxide gas in the emitted gas is absorbed by the bypass filter 17 within the bypass 14. Owing to this, it is arranged so that the smell and carbon dioxide gas in the air, which returns to the kitchen range 40 side, are absorbed as much as possible. Accordingly, the range hood 10 is arranged so as to prevent the smell, carbon dioxide gas and the like from returning to the inside of the kitchen by the bypass filter 17.

EXPLANATION OF THE REFERENCE NUMERALS

Figure 1:
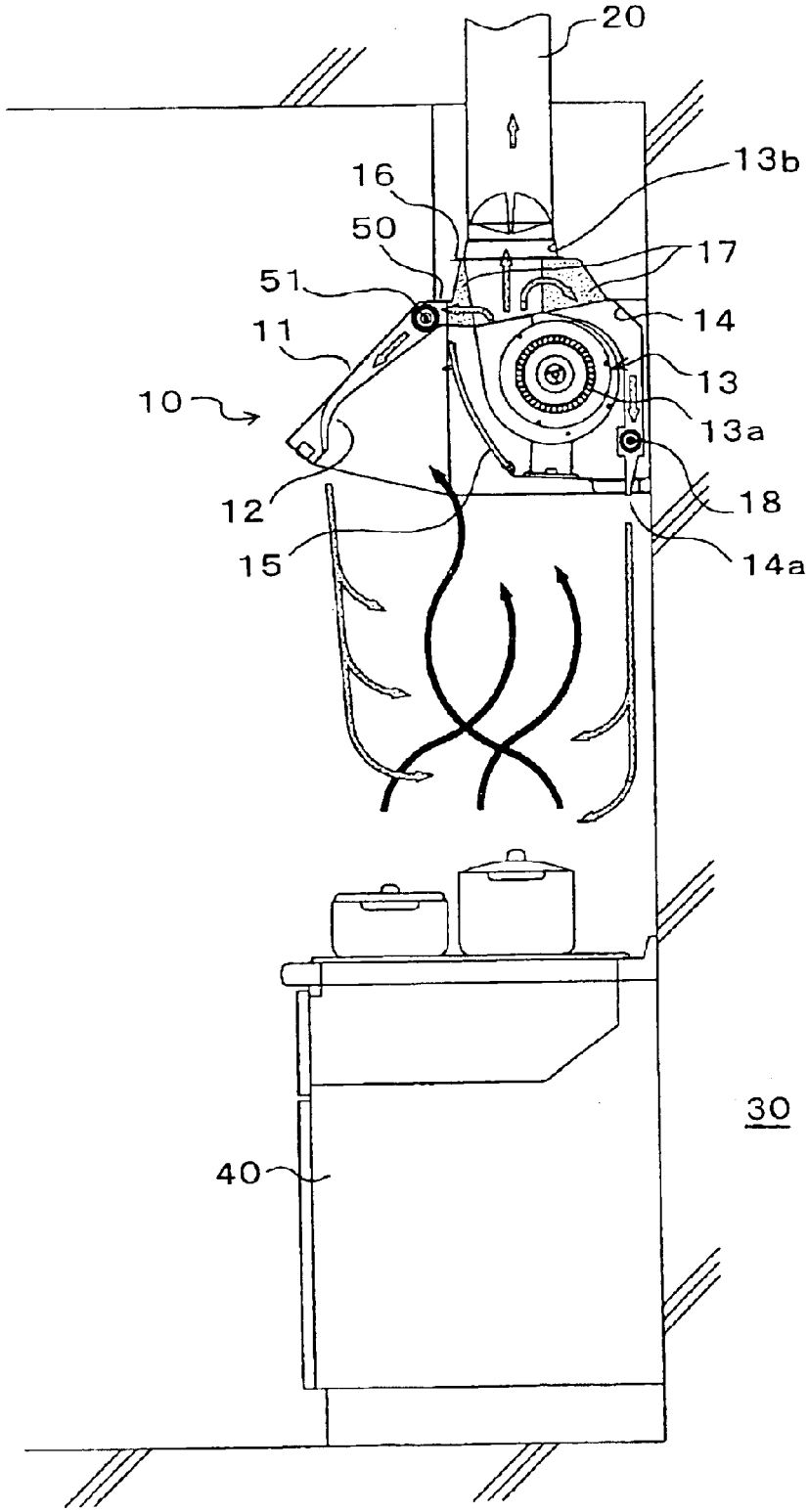
FIG. 1 is a sectional view of a range hood in accordance with the present invention.

10 range hood
11 hood main body
12 hood
13 evacuating fan
13*a* suction port
13*b* evacuating port
14 bypass
14*a* blowing port
15 filter
16 shutter
17 bypass filter
18 electric fan
19 condensation collector
20 evacuating duct
30 interior wall
40 kitchen range
50 second bypass
51 electric fan
52 slit

BEST MODE FOR CARRYING OUT THE INVENTION

Now, referring to the drawings, a range hood 10, which is an embodiment of the present invention, will be described below. In the range hood 10 in accordance with this embodiment, in the case of cooking appliance that burns a fuel gas, "emitted gas containing oily smoke and the like" is generated. And in the case of cooking appliance that uses electricity, such as electromagnetic cooking appliances, "air containing oily smoke" flows in the range hood 10. In any case, it is assumed that matters, which are drawn by an evacuating fan 13, are referred to as "emitted gas".

Figure 4:
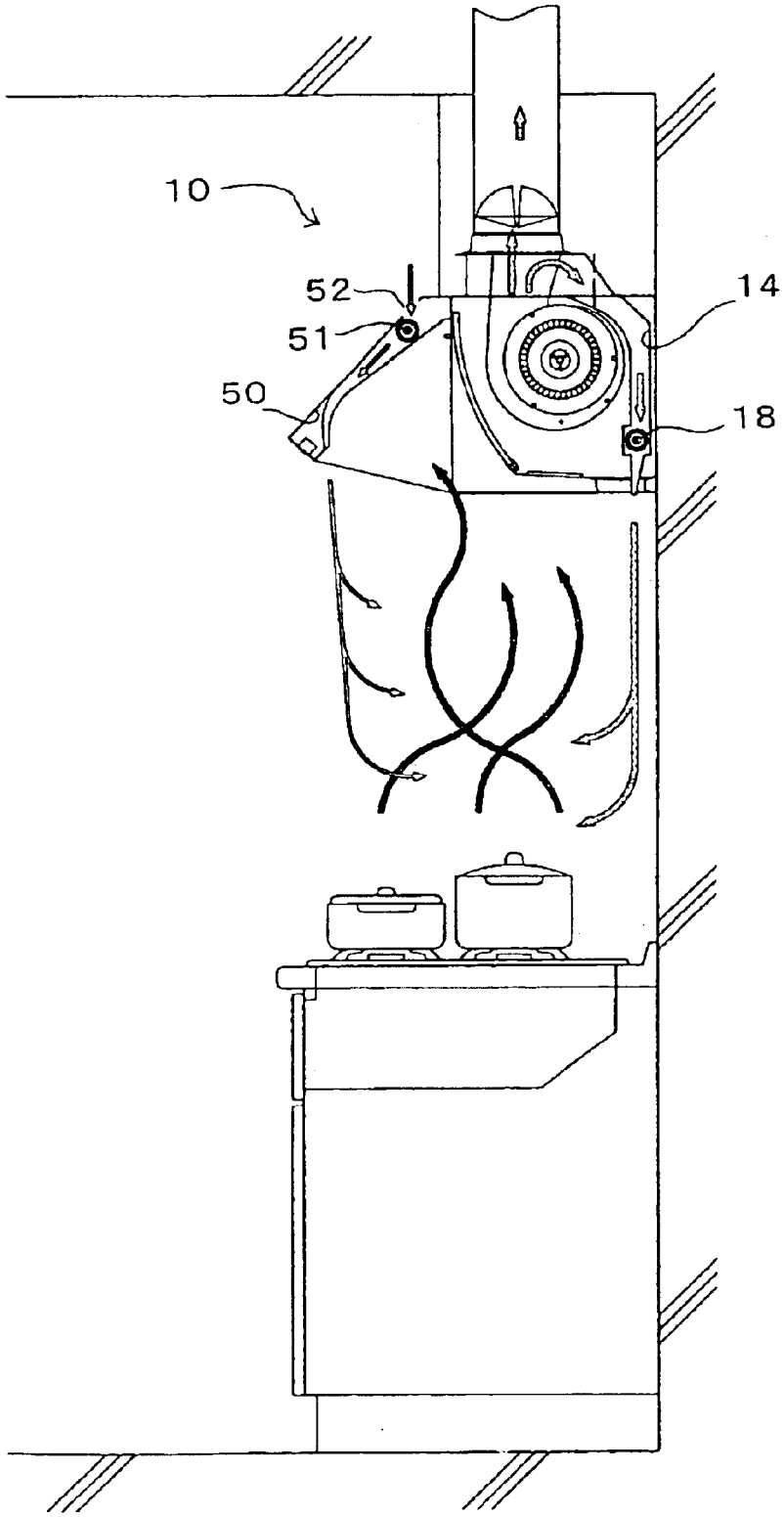
FIG. 4 is a sectional view of a range hood in accordance with another example of the present invention.

In FIG. 1 and FIG. 4 are sectional views respectively showing a kitchen range 40 disposed at the front face side of an interior wall 30 of a kitchen, and the range hood 10 in accordance with the present invention, which is located over the range 40 and installed on the interior wall 30 at the front face side thereof. The range hood 10 is for evacuating air or emitted gas, which contains vapor generated by cooking on the kitchen range 40, to the outside of a house. The range hood 10 comprises a hood main body 11 attached to the interior wall 30, a hood 12 opened at the lower end of the hood main body 11 for collecting the emitted gas and an evacuating fan 13 of which evacuating port 13*b* is connected to a duct 20, which is incorporated with the hood main body 11 therein and opened toward the outside of the house.

The range hood 10 has, in the hood 12 thereof, a filter 15 for trapping the oily smoke; thereby almost oily smoke is liquidized to remove therefrom. In the range hood 10 in accordance with the embodiment, after being liquidized, the trapped oily smoke is guided into a drain to be pooled to a certain level.

Figure 3:
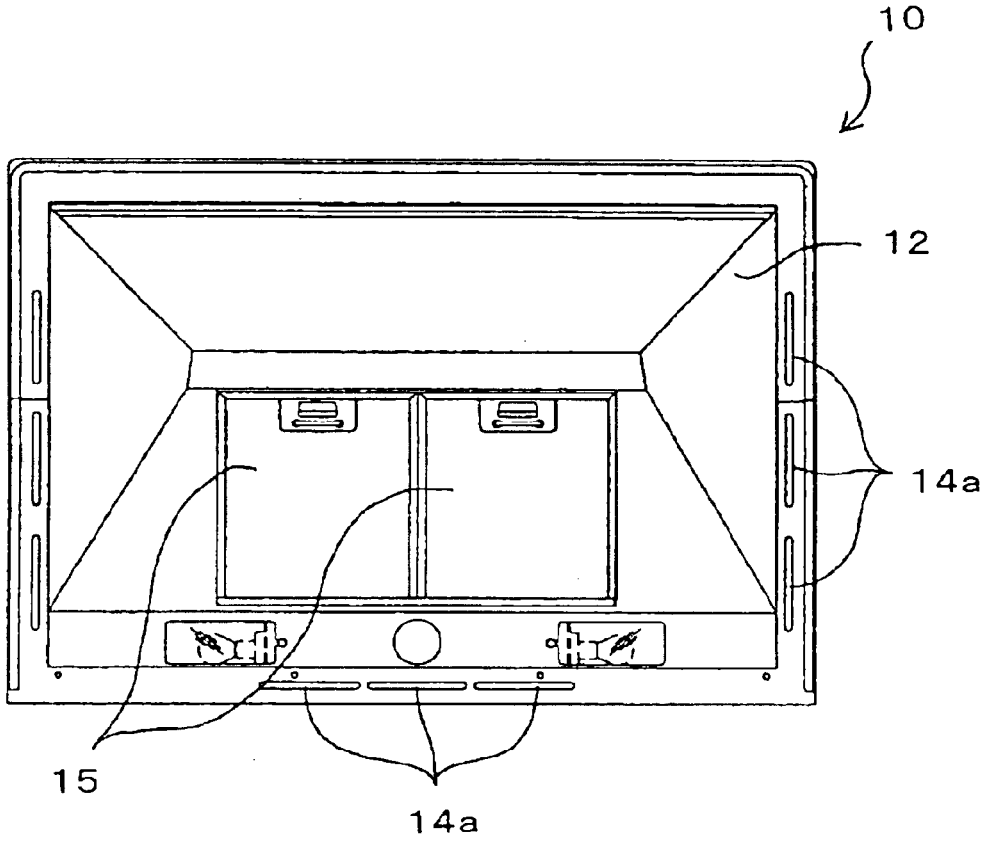
FIG. 3 is a bottom plan view of the range hood.

Referring to FIG. 1 or FIG. 4, in this range hood 10, a bypass 14 is formed in the hood main body 11 at the backside of the evacuating fan 13. The bypass 14 is communicated with the evacuating port 13*b* of the evacuating fan 13 at one end thereof; and the other end thereof is communicated with blowing ports 14*a*, which is formed at the wall 30 side of the hood. The bypass 14 is for, after drawing the air or emitted gas containing oily smoke, which is generated by cooking on the kitchen range 40 by means of the evacuating fan 13, returning a part of the air or emitted gas to the upper area of the kitchen range 40 again. As shown in FIG. 3, on the end portion of the bypass 14 at the kitchen range 40 side, a plurality of blowing ports 14*a* are formed. These blowing ports 14*a* are arranged so as to be located as close to the surface of the interior wall 30 as possible.

Also, in the range hood 10, a shutter 16 is provided in the evacuating port 13*b* at the head side of the bypass 14 and the behind of the evacuating fan 13. The shutter 16 is for controlling feeding of the air or emitted gas containing oily smoke into the bypass 14. As for the shutter 16, although various types are applicable, such shutter that opens to a pre-adjusted opening at the same time when the evacuating fan 13 is activated.

Further, as shown in FIG. 1, FIG. 2, FIG. 4 and FIG. 5, disposed in the bypass 14 at the inner side of these blowing ports 14*a* is an electric fan 18. The electric fan 18 operates in the bypass 14 for feeding a part of the air or emitted gas drawn by the evacuating fan 13 toward these blowing ports 14*a*.

Figure 2:
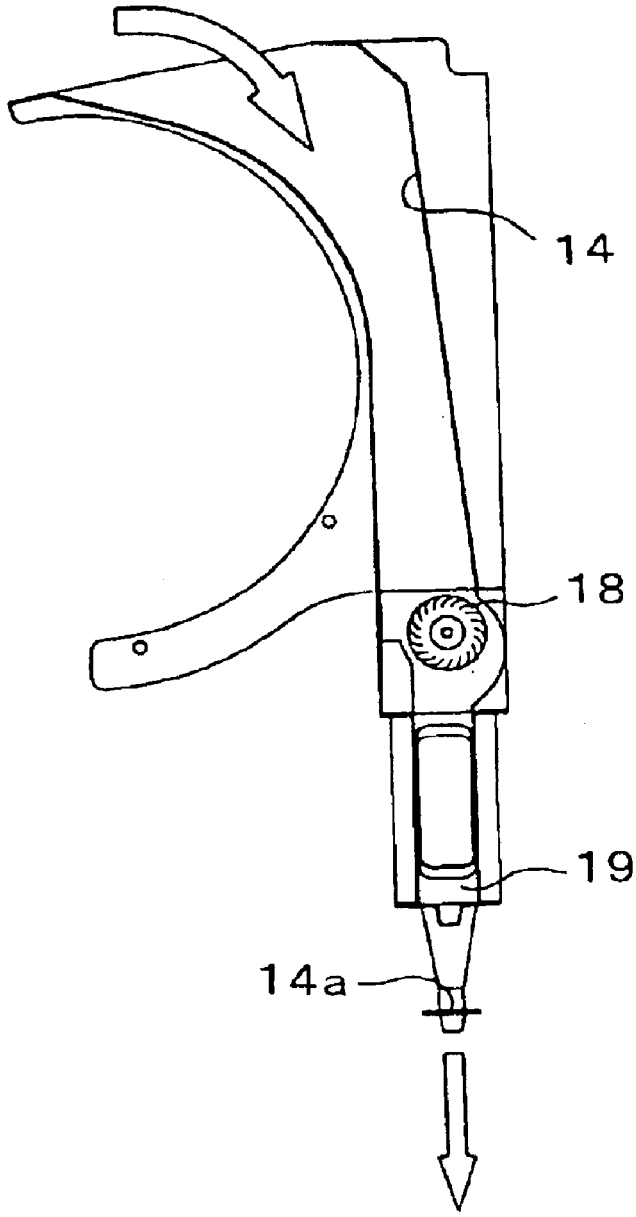
FIG. 2 is a partial section showing a state an electric fan constituting the range hood is unitized.

The electric fan 18 and the bypass 14 mounted therewith are integrated into a unit as shown in FIG. 2, and are arranged to serve as a cover for the evacuating fan 13. In this embodiment, in an inner portion of the blowing ports 14*a*, a condensation collector 19 is provided. The moisture contained in the emitted gas, which is blown out from these blowing ports 14*a*, is captured and collected by the condensation collector 19.

Furthermore, in the range hood 10, as shown with dots in FIG. 1, a bypass filter 17 for absorbing smell and carbon dioxide gas in the air or emitted gas is provided to inside the bypass 14. The bypass filter 17 employs porous material, such as, for example, active charcoal, for absorbing carbon dioxide gas and smell contained in the emitted gas.

Figure 5:
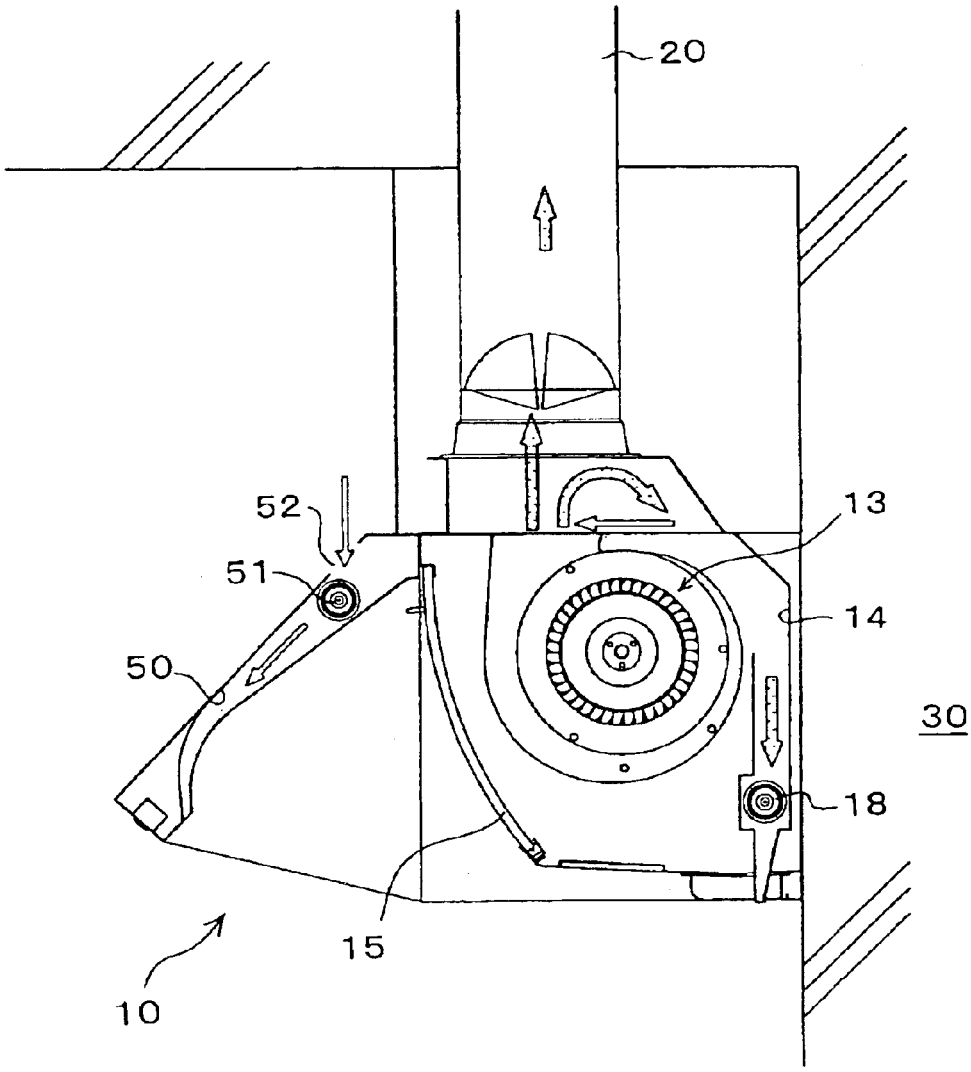
FIG. 5 is an enlarged sectional view showing a portion of the range hood.

In the range hood 10 of this embodiment, as shown in FIG. 1, FIG. 4 and FIG. 5, a second bypass 50 is formed at the front side of the hood main body 11. In the second bypass 50, an electric fan 51, which is the same as the electric fan 18 in the bypass 14, is provided. As shown in FIG. 1 and others, the second bypass 50 is, at the upper end thereof, opened to the evacuating port side of the evacuating fan 13, and at the lower end thereof, opened in the upper face of the hood 12.

From the second bypass 50, a part of the air or emitted gas, which is drawn and evacuated by the evacuating fan 13, flows as indicated by dotted arrowheads at the left side in FIG. 1 and FIG. 4. Owing to this, in the case of the kitchen range 40 that burns gas, by supplying the combustion air or the emitted gas, "air curtain effect" is created. In this case, owing to the electric fan 51 in the second bypass 50, the air curtain effect is made further reliable.

In the second bypass 50 shown in FIG. 4, a slit 52 is formed at the upper end side thereof. Accordingly, it is arranged so that the air can be drawn in from the outside of the range hood 10 through the slit 52. That is, the slit 52 is for taking the external air by means of flow of the combustion air or the emitted gas in the second bypass 50; thus the air curtain effect is made further reliably.

INDUSTRIAL APPLICABILITY

As described above in detail, in the present invention is, as demonstrated in the above embodiment:

"a range hood 10 comprising a hood main body 11, which is attached to an interior wall 30, for evacuating air or emitted gas containing oily smoke, vapor and the like generated by cooking on a kitchen range 40, a hood 12, which is opened at the lower end of the hood main body 11, for taking ascending emitted gas therein, an evacuating fan 13, which is incorporated in the hood main body 11, with a suction port thereof located in the hood main body 11, and an evacuating port 13*b*, which is formed in the upper portion of the evacuating fan 13 so as to be connected with an evacuating duct 20, characterized in that in the hood main body 11 and at the backside of the evacuating fan 13, a bypass 14 for said air or emitted gas containing oily smoke is formed, one end of the bypass 14 is communicated with the evacuating port 13*b* of the evacuating fan 13, and the other end of the bypass 14 is opened at the lower end of the hood main body 11 located at a wall 30 side of the hood and below the evacuating fan 13, and in the bypass 14, an electric fan 18 is provided."

Owing to this, it is possible to provide the range hood 10 that is capable of, needless to say about evacuating the air or emitted gas containing vapor and the like to the outside of a house, satisfactorily guiding ascending air current into the hood 12 while supplementing the shortage thereof, reducing the build-up of oily residue that generally accumulates on the surface of the interior wall 30, and further, supplying the air satisfactorily even in a high airtight kitchen.

What is claimed is:

1. A range hood comprising:

a hood main body, which is attached to an interior wall, for evacuating air or emitted gas containing oily smoke, and fumes generated by cooking on a kitchen range;

a hood, which is opened at the lower end of the hood main body, for drawing in ascending emitted gas;

an evacuating fan, which is incorporated in the hood main body, with a suction port thereof located in the hood main body;

an evacuating port, which is formed in the upper portion of the evacuating fan so as to be connected with an evacuating duct, wherein in the hood main body and at the backside of the evacuating fan, a bypass for the air or emitted gas containing oily smoke is formed, wherein one end of the bypass is in communication with the evacuating port of the evacuating fan, and the other end of the bypass is opened at the lower end of the hood main body located at the wall side of the hood adjacent to the wall or surface and below the evacuating fan;

an electric fan is provided in the bypass; and a blowing port is positioned in the hood main body wherein the blowing port directs air form the range hood substantially downward in front of the interior wall toward the kitchen range.

2. The range hood of claim 1 further comprising:

a second blowing port positioned at the front of the hood main body wherein the second blowing port directs air from the range hood substantially downward toward the kitchen range.

3. A range hood comprising:

a hood main body, which is attached to an interior wall, for evacuating air or emitted gas containing oily smoke, and fumes generated by cooking on a kitchen range;

a hood, which is opened at the lower end of the hood main body, for drawing in ascending emitted gas;

an evacuating fan, which is incorporated in the hood main body, with a suction port thereof located in the hood main body;

an evacuating port, which is formed in the upper portion of the evacuating fan so as to be connected with an evacuating duct; wherein in the hood main body and at the backside of the evacuating fan, a bypass for the air or emitted gas containing oily smoke is formed, wherein one end of the bypass is in communication with the evacuating port of the evacuating fan, and the other end of the bypass is opened at the lower end of the hood main body located at the wall side of the hood adjacent to the wall or surface and below the evacuating fan;

an electric fan is provided in the bypass; and a first blowing port is positioned in the hood main body wherein the blowing port directs air from the range hood substantially downward in front of the interior wall toward the kitchen range; and a second blowing port positioned at the front of the hood main body wherein the second blowing port directs air from the range hood substantially downward toward the kitchen range.

* * * * *